US006101653A

United States Patent [19]

England

[11] Patent Number: 6,101,653

[45] Date of Patent: Aug. 15, 2000

[54] SPILT SUPPORT CONFIGURATION MATTRESS

[75] Inventor: Rodney D. England, Tazewell, Tenn.

[73] Assignee: England/Corsair, Inc., New Tazewell, Tenn.

[21] Appl. No.: 09/253,333

[22] Filed: Feb. 22, 1999

[51] Int. Cl.[7] ..... A47C 27/05

[52] U.S. Cl. ..... 5/738; 5/727; 5/737

[58] Field of Search ..... 5/691, 722, 727, 5/728, 737, 738, 903

[56] References Cited

U.S. PATENT DOCUMENTS

| | | | |
|---|---|---|---|
| 3,493,980 | 2/1970 | Haller . | |
| 3,950,800 | 4/1976 | Garshfield . | |
| 4,112,556 | 9/1978 | Flaum et al. . | |
| 4,164,797 | 8/1979 | Golembeck . | |
| 4,213,214 | 7/1980 | Gilhooly . | |
| 4,365,371 | 12/1982 | Boussaroque | 5/738 X |
| 4,389,743 | 6/1983 | Callaway . | |
| 4,424,600 | 1/1984 | Callaway | 5/738 X |
| 4,638,517 | 1/1987 | Yang et al. . | |
| 4,809,375 | 3/1989 | Bull . | |
| 4,872,227 | 10/1989 | Galumbeck . | |
| 4,955,095 | 9/1990 | Gerrick | 5/738 X |
| 4,969,223 | 11/1990 | Yamaguchi | 5/738 X |
| 5,065,485 | 11/1991 | Zocco . | |
| 5,109,559 | 5/1992 | West . | |
| 5,136,741 | 8/1992 | Balonick et al. . | |
| 5,259,079 | 11/1993 | Visser et al. . | |
| 5,414,882 | 5/1995 | Goodale . | |
| 5,428,852 | 7/1995 | Tenuta et al. | 5/738 X |
| 5,488,746 | 2/1996 | Hudson | 5/903 |
| 5,513,402 | 5/1996 | Schwartz . | |

*Primary Examiner*—Michael F. Trettel
*Attorney, Agent, or Firm*—Harness Dickey & Pierce, P.L.C.

[57] ABSTRACT

A split support configuration mattress is provided including a mattress having a core element disposed therein and an upper portion defined over a top surface of the mattress core element. The upper portion includes a closure mechanism selectively permitting access to an interior volume thereof. The upper portion is divided along its length so as to define two substantially equal halves. A plurality of insertable auxiliary support elements are provided for selective combination and insertion into each half of the upper portion. As such, a split support configuration mattress is provided. Moreover, the dimensions of the individual auxiliary support elements are such that they may be easily stored, unstored, and interchanged by the mattress user.

19 Claims, 2 Drawing Sheets

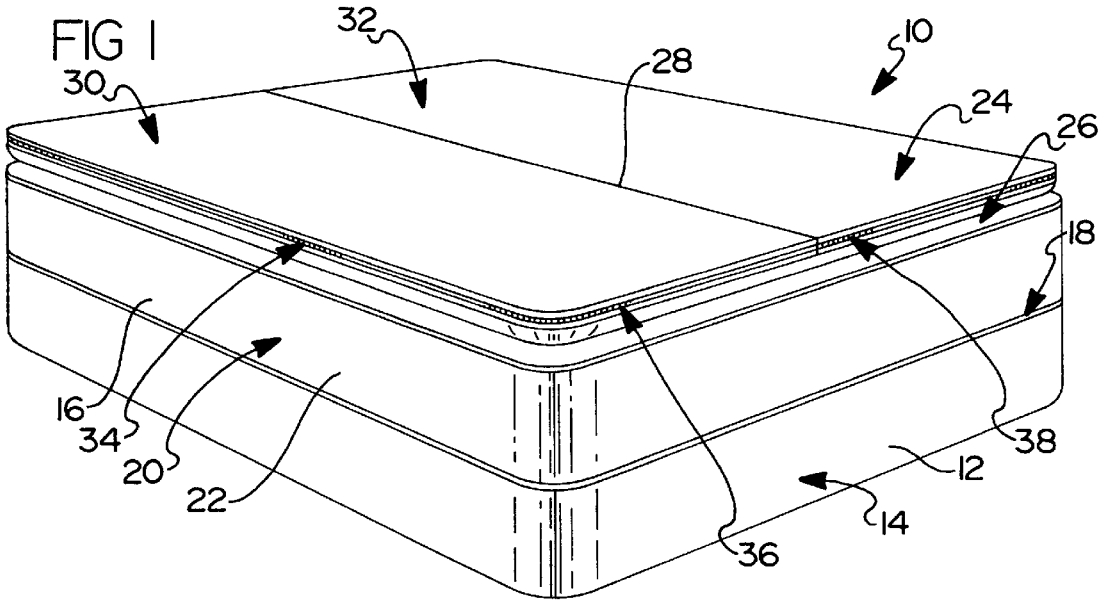
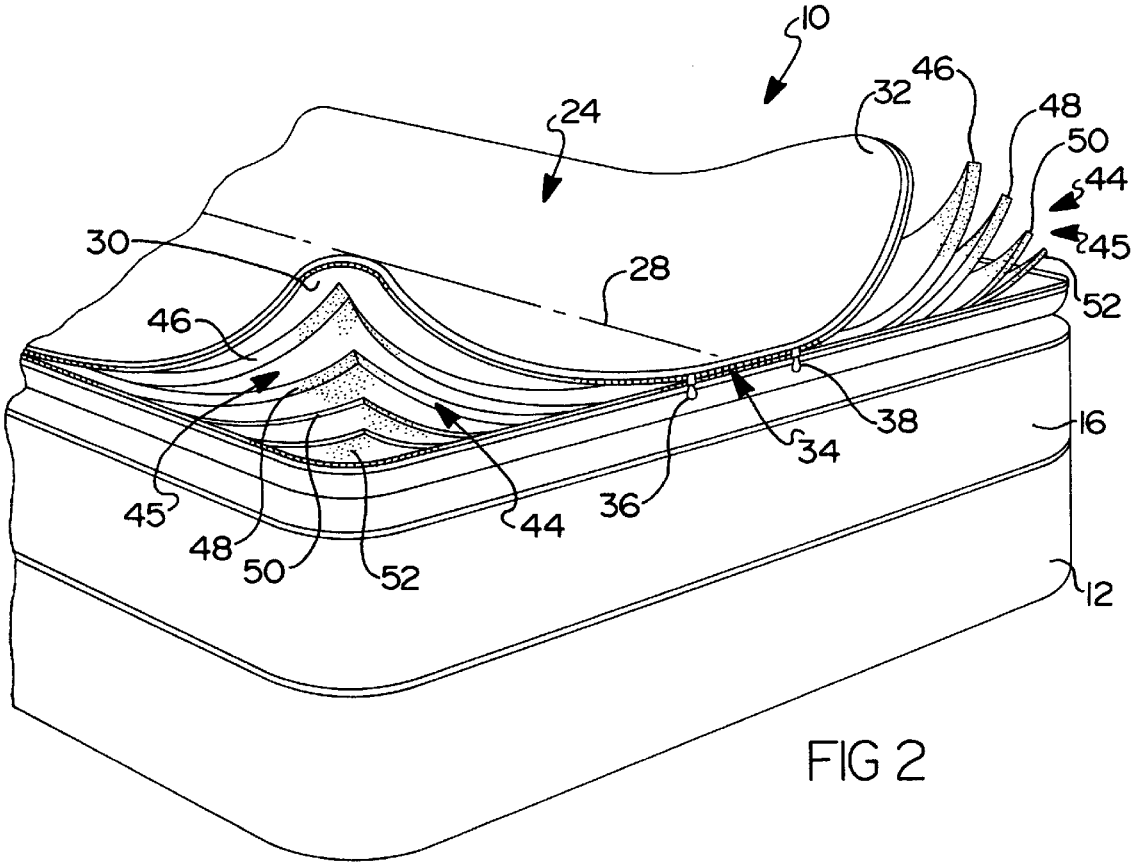
FIG 2

SPILT SUPPORT CONFIGURATION MATTRESS

BACKGROUND OF THE INVENTION

1. Technical Field

The present invention relates generally to mattress systems and, more particularly, to a mattress system having an accessible top portion capable of selectively receiving individual auxiliary mattress elements in a split support configuration.

2. Discussion

As is known, mattresses are available for purchase in varying degrees of firmness. As such, a purchaser can select to buy a mattress having soft, medium, or firm support. However, after purchase, the buyer is typically unable to adjust the firmness of the mattress.

One means of providing more choice in mattress configurations is to provide a first degree of firmness on one half of the mattress and a second type of firmness on the other half of the mattress. As such, two users of the same mattress can have each respective side tailored to their firmness preference. However, there is still no convenient means of changing the firmness of either side of the mattress should the user's preference change.

One means of addressing the above-identified problem is to provide a mattress arrangement with removable and/or interchangeable mattress core elements. Although this proposal has provided a means for a user to change the firmness of the mattress after purchase, the mattress core elements required to be removed and/or inserted into the mattress are of such a cumbersome nature that the interchanging must be performed at the manufacturer's facilities. As such, the mattress user cannot conveniently change the support configuration of the bed but must rather endure the time the manufacturer possesses the bed while interchanging the mattress elements.

Therefore, it would be desirable to provide a mattress system having an internally accessible portion wherein interchangeable auxiliary support elements may be inserted by the end user.

SUMMARY OF THE INVENTION

The above and other objects are provided by a split support configuration mattress including a mattress having a core element disposed therein and an upper portion defined over a top surface of the core element. The upper portion includes a closure mechanism selectively permitting access to an interior volume thereof. The upper portion is divided along its length so as to define two substantially equal halves. A plurality of insertable auxiliary support elements are provided for selective combination and insertion into each half of the mattress upper portion. As such, a split support configuration mattress is provided. Moreover, the dimensions of the individual auxiliary support elements are such that they may be easily stored, unstored, and interchanged by the mattress owner.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which:

FIG. 1 is a perspective view of the split support configuration mattress of the present invention in its use mode;

FIG. 2 is a perspective view of the split support configuration mattress of the present invention in an interchange mode.

DETAILED DESCRIPTION OF THE PREFERRED EMBODIMENTS

Figure 3:
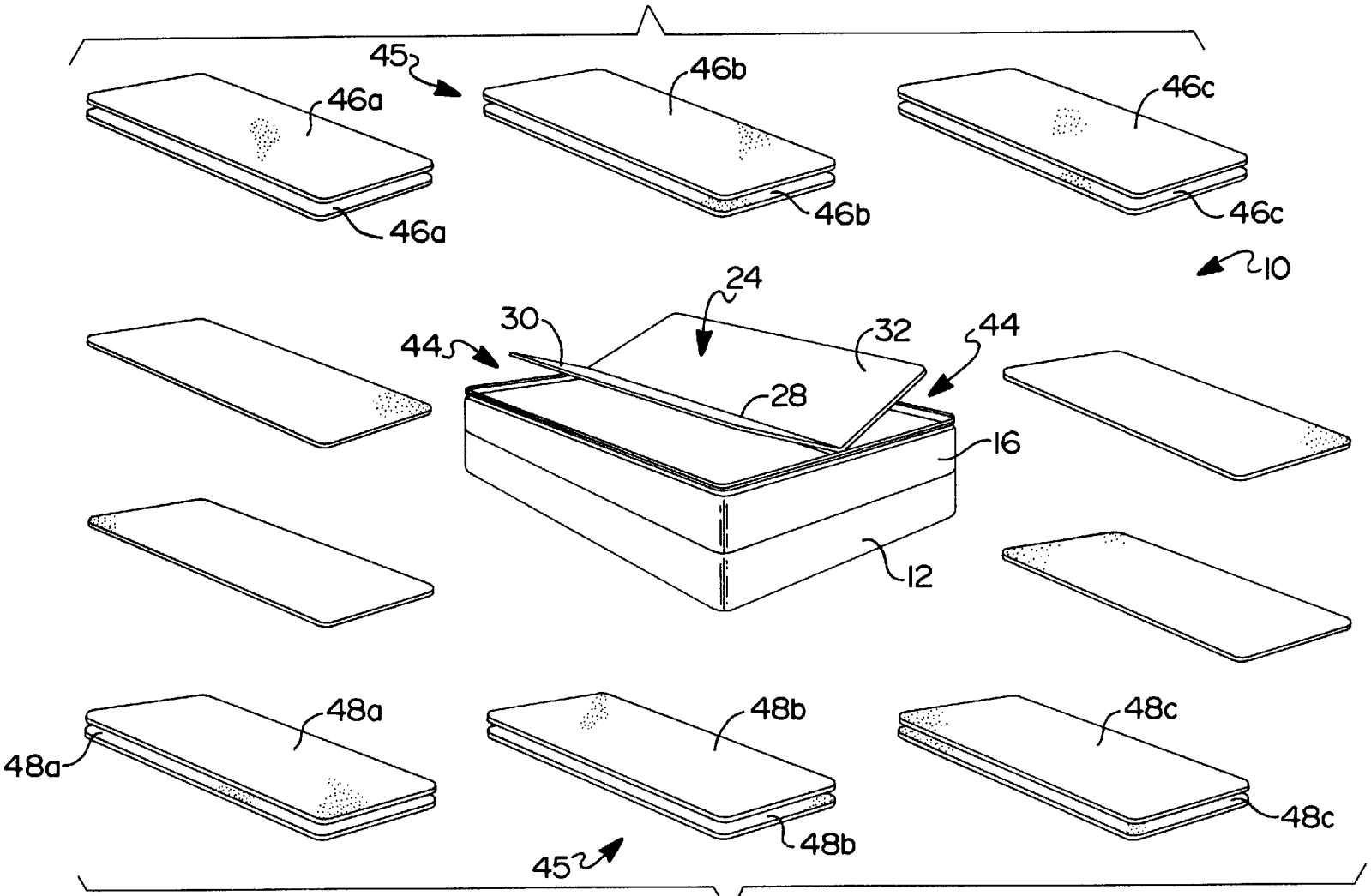
FIG. 3 is an exploded view of the split support configuration mattress of the present invention illustrating a kit of interchangeable support elements for use therein.

The present invention is directed towards a split support configuration mattress having an upper portion defined above a top surface of a mattress core element. The portion includes a closure mechanism for selectively enabling access to an interior volume thereof. A plurality of auxiliary support elements may be interchangeably inserted into the interior of the upper portion to provide varying degrees of firmness in each of the two halves of the mattress.

Referring now to the drawing figures, FIG. 1 illustrates the split support configuration mattress 10 of the present invention in a first or closed mode. Since the present invention is primarily directed towards a mattress having two discrete degrees of firmness on either side, the mattress 10 is preferably a "double" size mattress or larger design to support two occupants. The mattress system 10 includes a box spring 12 including a fabric cover 14 enclosing a conventional internal box spring structure (not illustrated). A mattress 16 is supported on a top surface 18 of the box spring 12. The mattress 16 includes a fabric cover 20 enclosing a conventional foam core (not illustrated) to form a main mattress portion 22. The fabric cover 20 also encloses an upper portion 24 secured to a top surface 26 of the main mattress portion 22.

Although the main mattress portion 22 is illustrated as including an upper portion 24 in the form of a pillow-top, one skilled in the art will appreciate that an upper volume or void can be provided between the foam core of the mattress and the top surface 26 of the fabric cover 20. As such, the following description can be equally applied to a mattress configuration including a conventional quilt-top configuration rather than the pillow-top configuration illustrated so long as sufficient space is provided between the foam core and the fabric cover for accommodating the auxiliary support elements described below.

The upper or pillow-top portion 24 is divided along its length by a seam 28 to define two separate halves 30 and 32. A closure mechanism 34 is provided about the perimeter of the pillow-top portion 24 for selectively permitting access to an interior volume of the pillow-top portion 24. Preferably, the closure mechanism 34 includes two oppositely oriented separate devices 36 and 38 which terminate adjacent the seam 28. Although any number of closure mechanisms may be used such as snaps, buttons, hook-and-loop fasteners and the like, it is presently preferred that the closure mechanism 34 consist of a pair of zippers.

Referring now also to FIG. 2, the split support configuration mattress 10 of the present invention is illustrated in a second, open, or interchange mode. By opening the closure mechanism 34, access to the interior 44 of the upper of pillow-top portion 24 is provided. More particularly, unzipping the first zipper 36 allows the first half 30 of the pillow-top portion 24 to be folded along the seam 28 away from the mattress 16. Similarly, unzipping the second zipper 38 allows the second half 32 of the pillow-top portion 24 to be folded along the seam 28 away from the mattress 16. As such, access to the auxiliary support elements 45 disposed within the interior 44 of the pillow-top portion 24 is provided. The support elements preferably include a first foam pad 46, a second foam pad 48, a felt pad 50 and a liner 52. As can be appreciated, each of the support elements is considerably thinner than the foam core of the mattress 22.

Turning now to FIG. 3, an exploded view of the split support configuration mattress 10 is illustrated. As can be appreciated from the drawing figure, the interior 44 of both halves 30 and 32 of the upper pillow-top portion 24 are configured to retain a plurality of interchangeable-auxiliary support elements 45. In accordance with the teachings of the present invention, the particular combination of the support elements 45, and particularly, the first and/or second foam pads 46 and 48, may be selected by the mattress user to provide a desired degree of firmness.

To effectuate the foregoing, each mattress includes a support configuration kit 49 having two felt pads 50, two liners 52, and two sets of three first foam pads 46*a–c* and two sets of three second foam pads 48*a–c*. Each set of three first foam pads 46 includes a soft pad 46*a*, a medium pad 46*b*, and a firm pad 46*c*. Similarly, each set of three second foam pads 48 includes a soft pad 48*a*, a medium pad 48*b*, and a firm pad 48*c*. For the purpose of this disclosure, the terms soft, medium and firm shall mean a low, medium, and high degree of occupant support. Further, it should be appreciated that the first foam pads 46*a–c* are of a different support class (i.e., they are generally more or less dense) than the second foam pads 48*a–c*. As such a soft first pad 46*a* will provide a different degree of support than a soft second pad 48*a*.

With the kit 49, the mattress user may combine any of the soft, medium, and firm first foam pads 46*a–c* with any of the soft, medium, and firm second pads 48*a–c* to provide a desired degree of firmness on each half 30, 32 of the mattress 16. Alternately, the user may combine two of the first foam pads 46*a–c* or two of the second foam pads 48*a–c*, if desired. Further, two of the same type of firmness first or second foam pads 46*a–c*, 48*a–c* may be combined (e.g., two firm first foam pads 46*c* or two soft second foam pads 48*a*). Advantageously, since the first and second foam pads 46*a–c* and 48*a–c* are relatively thin (as compared to the foam core of the main mattress), they may be conveniently stored by the mattress user and interchanged should the user's desired degree of firmness change.

Thus, a split support configuration mattress is provided including an upper portion having a closure mechanism formed thereabout for selectively providing access to an interior volume thereof. A plurality of auxiliary support elements can be selectively interchanged within each half of the interior volume of the upper portion such that select levels of firmness can be provided on each half of the mattress. Furthermore, since the support elements are relatively small, a kit of support elements may be provided such that the mattress firmness can be selectively changed by the mattress user.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A mattress comprising:

a body;

a core support member disposed in said body;

an upper portion between said core support member and said body;

a divider separating said upper portion into two halves;

a closure mechanism coupled to said body adjacent said upper portion selectively providing access to an interior volume thereof; and at least one auxiliary support element removably disposed within said interior volume of said upper portion by way of said closure mechanism.

2. The mattress of claim 1 wherein said at least one auxiliary support element further comprises at least one support element positioned within each of said two halves of said upper portion.

3. The mattress of claim 1 wherein said closure mechanism is disposed along a perimeter of said upper portion.

4. The mattress of claim 1 wherein said closure mechanism further comprises a zipper.

5. The mattress of claim 1 wherein said closure mechanism further comprises two discrete closure devices.

6. The mattress of claim 5 wherein said two discrete closure devices further comprise zippers.

7. The mattress of claim 1 wherein said at least one auxiliary support element further comprises a plurality of foam pads.

8. A split support configuration mattress comprising:

a fabric body;

a core support member disposed within said fabric body;

an upper portion between said core support member and a top surface of said fabric body;

a divider separating said upper portion into a first lateral half and a second lateral half;

a closure mechanism coupled to said fabric along a perimeter of said upper portion selectively providing access to an interior volume of said first lateral half and said second lateral half of said upper portion;

a first plurality of auxiliary support elements removably disposed in said interior volume of said first lateral half of said upper portion; and a second plurality of auxiliary support elements removably disposed in said interior volume of said second lateral half of said upper portion.

9. The split support configuration mattress of claim 8 wherein said closure mechanism further comprises a first closure member disposed along a perimeter of said first lateral half of said upper portion and a second closure member disposed along a perimeter of said second lateral half of said upper portion.

10. The split support configuration mattress of claim 9 wherein said first and second closure members terminate proximate said divider.

11. The split support configuration mattress of claim 10 wherein said first and second closure members further comprise zippers.

12. The split support configuration mattress of claim 8 wherein said first and second plurality of auxiliary support elements further comprise at least two foam pads having a thickness which is relatively small as compared to said core support member.

13. The split support configuration mattress of claim 8 wherein said first plurality of auxiliary support elements are selected from the group including a first soft pad, a first medium pad, a first firm pad, a second soft pad, a second medium pad, and a second firm pad.

14. The split support configuration mattress of claim 8 wherein said second plurality of auxiliary support elements are selected from the group including a first soft pad, a first medium pad, a first firm pad, a second soft pad, a second medium pad, and a second firm pad.

15. The split support configuration mattress of claim 8 wherein said first plurality of auxiliary support elements yield a degree of occupant support which is different from a degree of occupant support yielded by said second plurality of auxiliary support elements.

16. A split support configuration mattress kit comprising:

a mattress including a fabric body enclosing a core support member so as to form an upper void portion between said core support member and said body, said fabric body portion including a closure mechanism coupled thereto selectively providing access to an interior portion of said upper void portion;

a first plurality of support elements removably disposed in said interior portion of said upper void portion, said first plurality of support elements being selected from the group including a first soft pad, a first medium pad, a first firm pad, a second soft pad, a second medium pad, and a second firm pad; and a second plurality of support elements removably disposed in said interior portion of said upper void portion, said second plurality of support elements being selected from the group including a first soft pad, a first medium pad, a first firm pad, a second soft pad, a second medium pad, and a second firm pad.

17. The split support configuration mattress kit of claim 16 further comprising a divider separating said upper void portion into a first lateral half and a second lateral half.

18. The split support configuration mattress kit of claim 16 wherein said closure mechanism further comprises at least one zipper disposed along a perimeter of said upper void portion.

19. The split support configuration mattress kit of claim 16 wherein said upper void portion further comprises a pillow-top section of said fabric body.

* * * * *